US010516196B2

(12) United States Patent
Accatino et al.

(10) Patent No.: US 10,516,196 B2
(45) Date of Patent: Dec. 24, 2019

(54) DUAL MODE CAVITY FILTER AND SYSTEM COMPRISING SUCH FILTER

(71) Applicant: AC CONSULTING DI LUCIANO ACCATINO, Rivoli (TO) (IT)

(72) Inventors: Luciano Accatino, Rivoli (IT); Giorgio Bertin, Rivoli (IT)

(73) Assignee: AC CONSULTING DI LUCIANO ACCATINO, Rivoli (TO) (IT)

( * ) Notice: Subject to any disclaimer, the term of this patent is extended or adjusted under 35 U.S.C. 154(b) by 124 days.

(21) Appl. No.: 15/575,010

(22) PCT Filed: May 13, 2016

(86) PCT No.: PCT/EP2016/060839
§ 371 (c)(1),
(2) Date: Nov. 17, 2017

(87) PCT Pub. No.: WO2016/184804
PCT Pub. Date: Nov. 24, 2016

(65) Prior Publication Data

US 2018/0145386 A1 May 24, 2018

(30) Foreign Application Priority Data

May 20, 2015 (IT) ..... UB2015A0869

(51) Int. Cl.
*H01P 1/208* (2006.01)
*H01P 7/06* (2006.01)
*H01P 7/10* (2006.01)

(52) U.S. Cl.
CPC ..... *H01P 1/2082* (2013.01); *H01P 7/06* (2013.01); *H01P 7/105* (2013.01)

(58) Field of Classification Search
CPC ..... H01P 1/207; H01P 1/208; H01P 1/2082; H01P 1/2086; H01P 7/105
(Continued)

(56) References Cited

U.S. PATENT DOCUMENTS 4,251,787 A 2/1981 Young et al.
4,792,771 A * 12/1988 Siu ..... H01P 1/2082 333/208
(Continued)

FOREIGN PATENT DOCUMENTS

| | | |
|---|---|---|
| CA | 1208717 | 7/1986 |
| EP | 2355235 A1 | 8/2011 |
| WO | 2005045985 A1 | 5/2005 |

OTHER PUBLICATIONS

Mira, et al., Fast and Accurate Cad Tool of Passive Rectangular . . . , European Microwave Conference Cnit LA Defense, vol. 2, pp. 939-942, 2005.
(Continued)

*Primary Examiner* — Rakesh B Patel
(74) *Attorney, Agent, or Firm* — Lucas & Mercanti, LLP

(57) ABSTRACT

A dual mode cavity filter installed aboard a satellite having a first and a second waveguide cavity, a first coupling waveguide iris having an input slot and followed by the first waveguide cavity, a second coupling waveguide iris having a coupling slot, following the first waveguide cavity and followed by the second waveguide cavity, and a third coupling waveguide iris having an output slot and following the second waveguide cavity. The dual mode cavity filter is associated with a plurality of devices having at least one respective commanded rod having a certain insertion length with respect of the waveguide cavities and of the slots. The devices are placed in predetermined positions of the cavities and/or of the irises and are arranged to perform a tuning modification and/or a coupling modification of the filter by controlling the insertion length of the rods in outer space.

20 Claims, 4 Drawing Sheets

(58) Field of Classification Search
USPC ..... 333/207–209
See application file for complete search history.

(56) References Cited

U.S. PATENT DOCUMENTS

| | | | | |
|---|---|---|---|---|
| 5,012,211 | A | 4/1991 | Young et al. | |
| 2002/0167379 | A1 | 11/2002 | Holme et al. | |
| 2005/0200437 | A1* | 9/2005 | Pance ..... | H01P 1/2084 333/235 |

OTHER PUBLICATIONS

International Search Report and Written Opinion for International Application No. PCT/EP2016/060839 (dated Nov. 3, 2016) (14 Pages).

* cited by examiner

DUAL MODE CAVITY FILTER AND SYSTEM COMPRISING SUCH FILTER

CROSS-REFERENCE TO RELATED APPLICATIONS

This application is a 371 of PCT/EP2016/060839, filed May 13, 2016, which claims the benefit of Italian Patent Application No. UB2015A000869, filed May 20, 2015.

TECHNICAL FIELD

Present invention relates, in general, to a dual mode cavity filter.

In particular, present invention relates to dual mode cavity filters to be installed aboard a satellite as input and/or output filtering assemblies.

BACKGROUND ART

As known, dual mode cavity filters, hereinafter named filters for sake of simplicity, are usually installed aboard communication satellites so as to realise output multiplexers (OMUX) and/or input multiplexers (IMUX).

Such filters comprise, for instance, two waveguide cavities and three coupling irises and are used for filtering in and/or out communications, for instance radio and/or television communications from earth apparatuses to the satellite and vice-versa.

According to known prior art, the dual mode filters are tuned before the satellite is sent to outer space, according to a set of specifications including centre frequency and bandwidth, and the tuning is made by inserting and locking, in predefined locations along the cavities, metallic screws at certain insertion lengths inside cavities.

In case a need appears to modify input/output filter characteristics, for instance centre frequency and/or bandwidth, a problem exists because filtering characteristics are strictly connected to the tuning made before sending the satellite in the outer space, i.e. to the screw location and insertion length.

Therefore, prior art seems to be not able to solve the problem of changing the characteristics of dual mode filters after sending communication satellites in the outer space.

In summary, Applicant has noted that prior art is not able to solve the problem of changing the filter characteristics, as for instance centre frequency and bandwidth of dual mode cavity filters, after sending the filters installed aboard a satellite in the outer space.

DISCLOSURE OF THE INVENTION

The object of the present invention is thus to solve the problems outlined above.

According to the present invention, such an object is achieved by means of a dual mode cavity filter having the features set forth in the claims that follow.

The present invention also relates to a device to be installed in the dual mode cavity filters of the invention.

The present invention also relates to a system comprising at least one dual mode cavity filter according to the present invention and a tele-commanded equipment configured to control a plurality of devices installed in the dual mode cavity filter.

Claims are an integral part of the teaching of the present invention.

The following summary of the invention is provided in order to provide a basic understanding of some aspects and features of the invention. This summary is not an extensive overview of the invention, and as such it is not intended to particularly identify key or critical elements of the invention, or to delineate the scope of the invention. Its sole purpose is to present some concepts of the invention in a simplified form as a prelude to the more detailed description that is presented below.

According to a feature of a preferred embodiment, the dual mode cavity filter is associated with a plurality of devices being placed in predetermined positions of cavities and irises of the dual mode cavity filter and being arranged to perform, in use in outer space, a tuning modification and/or a coupling modification of said filter. The tuning and/or coupling modifications are performed by moving rods connectable to each device, in order to change the insertion lengths of the rods inside the cavities and the irises of the filter.

According to another feature of the present invention, the dual mode cavity filter is part of a system installed aboard a satellite, which comprises a tele-commanded equipment adapted to control the plurality of devices on the basis of instructions to modify the tuning and/or the coupling. The instructions can be received by the tele-commanded equipment remotely, e.g. from Earth, while the satellite is in use in outer space.

BRIEF DESCRIPTION OF DRAWINGS

These and further features and advantages of the present invention will appear more clearly from the following detailed description of a preferred embodiment, provided by way of non-limiting example with reference to the attached drawings, in which components designated by same or similar reference numerals indicate components having same or similar functionality and construction and wherein.

BEST MODE FOR CARRYING OUT THE INVENTION

Figure 1A:
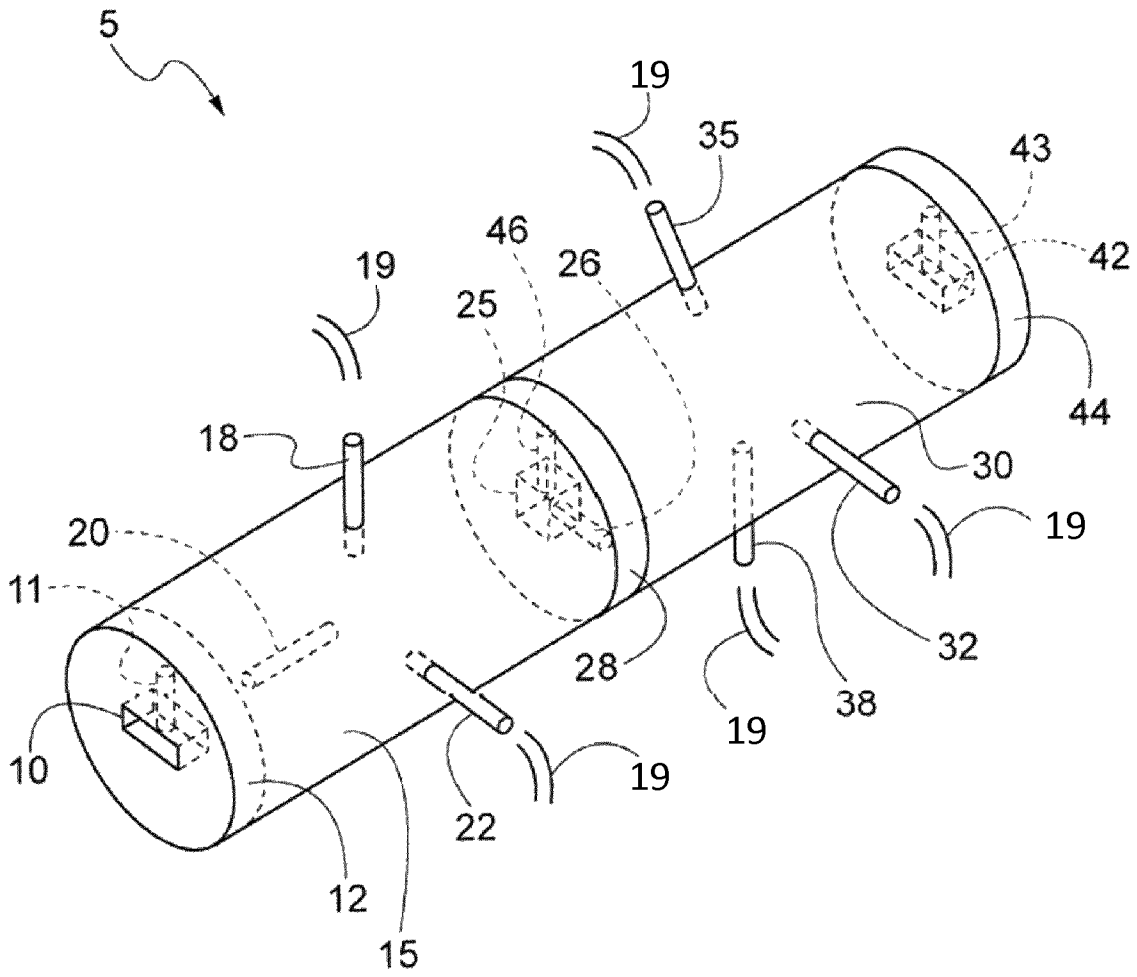
FIG. 1*a* shows a perspective view of a dual mode cavity filter with motorised (or commanded) rods, wherein devices for controlling the insertion length of the motorised rods are not shown for the sake of simplicity.
Figure 1C:
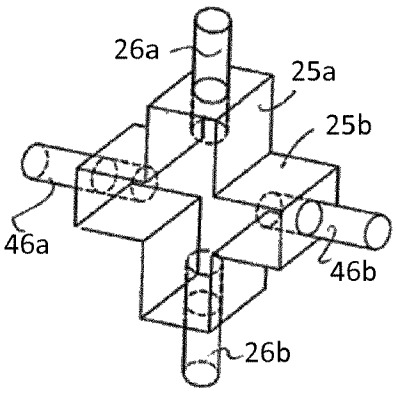
FIG. 1*c* shows a perspective view of a second type of irises that can be used in the dual mode cavity filter of FIG. 1*b;*
Figure 1B:
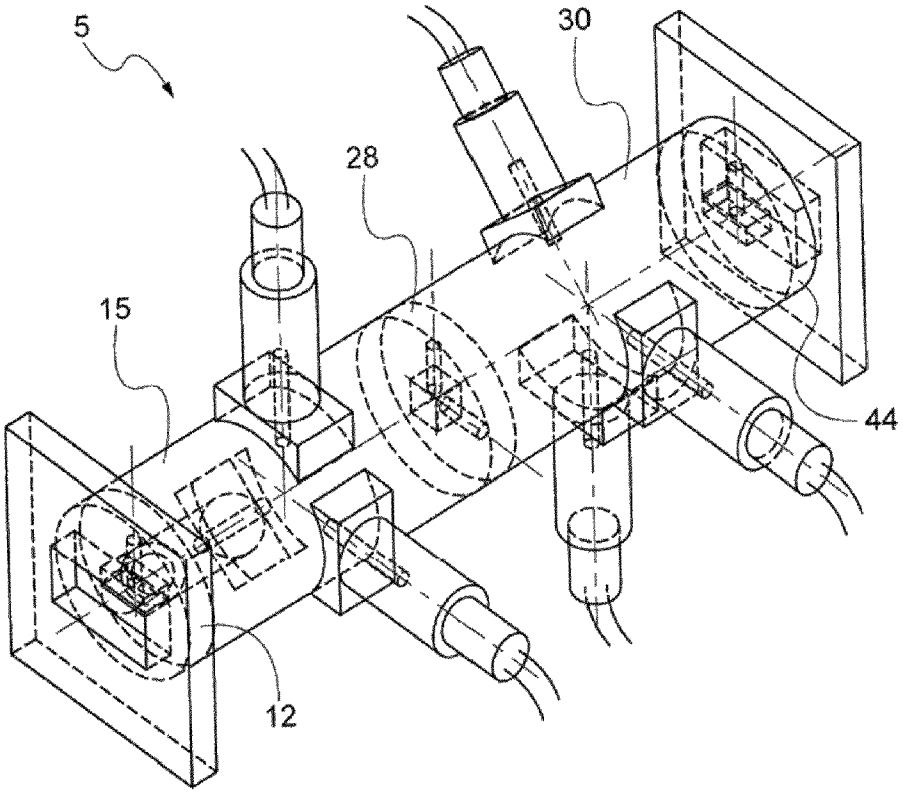
FIG. 1*b* shows a perspective view of a dual mode cavity filter with the devices controlling the insertion length of the motorised (or commanded) rods, wherein a first type of irises is shown but the devices inside the irises are not shown for the sake of simplicity.

With reference to FIG. 1*a*, 1*b* a dual mode cavity filter (filter) 5 is shown, comprising a first 15 and a second circular waveguide cavity 30 and three coupling waveguide irises 12, 28, 44, so as to compose a four-pole elliptic filter.

The filter provides an architecture where a first iris 12 is followed by a first cavity 15 which is followed by a second iris 28, in known way, and where the second iris 28 is followed by the second cavity 30 which is followed by a third iris, in known way.

According to a preferred embodiment the first iris 12 comprises, for instance, one input horizontal slot 10 and one motorised (or commanded) controlling rod 11 arranged to couple an external vertical field into the first circular cavity 15 controlled by a tele-commanded equipment 80 (FIG. 1*a*, FIG. 5), as will be disclosed later on in detail.

The first cavity 15, for instance, supports a first vertically polarised resonant mode, the resonant frequency of which is tuned through a first motorised tuning rod 18 which is controlled by the tele-commanded equipment 80, as will be disclosed later on in detail.

The first cavity 15 further comprises a motorised coupling rod 20, angularly displaced by an odd number of 45° angles relative to the first motorized tuning rod, arranged to provide a controlled coupling to a second horizontally polarised resonant mode.

Moreover, the first cavity supports the second horizontally polarized resonant mode, the resonant frequency of which is tuned through a second motorised tuning rod 22, which is controlled by the tele-commanded equipment 80, as will be disclosed later on in detail.

According to a first preferred embodiment, the second iris 28 comprises, for instance, one rectangular coupling slot 25 and a first motorised controlling rod 26, arranged to couple the second horizontally polarised resonant mode inside cavity 15 to a third horizontally polarised resonant mode inside the second cavity 30.

According to a second preferred embodiment (FIG. 1*c*), the second iris 28 is shaped, for instance, as one cross-shaped slot comprising one vertical slot 25*a* and one horizontal slot 25*b*.

According to this embodiment the iris 28 comprises a first pair of motorised rods 26*a* and 26*b* arranged to control the coupling of the vertical slot 25*a* and a second pair of motorised rods 46*a* and 46*b* arranged to control the coupling of the horizontal slot 25*b*.

Preferably, the vertical slot 25*a* is arranged to couple the second horizontally polarised resonant mode inside cavity 15 to a third horizontally polarised resonant mode inside the second cavity 30.

The resonant frequency of the third resonant mode inside the second cavity 30 is tuned through a third motorised tuning rod 32, controlled by the tele-commanded equipment 80, as will be disclosed later on in detail.

The second cavity 30 further comprises a motorised coupling rod 35 displaced by an odd number of 45° angles relative to the third motorised tuning rod 32, arranged to provide a controlled coupling to a fourth vertically polarised resonant mode under the control of the tele-commanded equipment 80.

The resonant frequency of the fourth vertically polarised resonant mode is tuned through a fourth motorised tuning rod 38 which is controlled by the tele-commanded equipment 80.

According to the preferred embodiment the third iris 44 comprises, for instance, an output horizontal slot 42 and a motorised controlling rod 43, arranged to couple the fourth vertically polarised resonant mode inside circular cavity 30 to an external vertical field.

According to the architecture of the filters, owing to an appropriate displacement of the coupling rods 20 and 35, of known type, the first vertically polarised resonant mode inside cavity 15, tuned by the first motorised tuning rod 18, and the fourth vertically polarised resonant mode inside cavity 30, tuned by the fourth motorised tuning rod 38, have a common vertical polarisation but opposite directions.

According to the first preferred embodiment, the rectangular coupling slot 25, properly designed using modal techniques according to known prior art, in addition to the coupling between the second and the third horizontally polarised resonant modes, provides a negative coupling between the first and the fourth vertically polarised resonant modes. This negative coupling is controlled, for instance, by a second motorised controlling rod 46 and creates in a known way a pair of transmission zeros, one below and one above the filter passband, as shown in FIG. 6.

Figure 6:
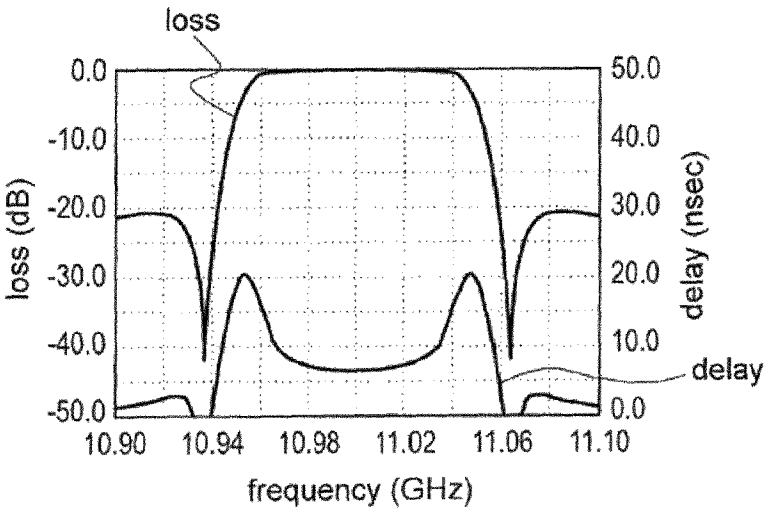
FIG. 6 shows a graph of a band-pass transfer function of a dual mode cavity filter.

According to the second preferred embodiment (FIG. 1*c*), the horizontal slot 25*b* in the cross-shaped coupling iris provides a negative coupling between the first and the fourth vertically polarised resonant modes whereby the second pair of motorised rods 46*a* and 46*b* are arranged to control the coupling of the horizontal slot 25*b* and to create a pair of transmission zeros, one below and one above the filter passband, as shown in FIG. 6.

According to another embodiment of the present invention, the dual mode cavity filter comprises a subset of the rods described above, consisting of the motorised tuning rods 18, 22 of the first cavity 15 and of the motorised tuning rods 32, 38 of the second cavity 30.

As set above, the motorised tuning rods 18, 22 of the first cavity 15 allow to tune the resonant frequency of the first vertically polarized resonant mode, and the motorised tuning rods 32, 38 of the second cavity 30 allow to tune the resonant frequency of the second horizontally polarized resonant mode.

According to another embodiment of the present invention, the dual mode cavity filter comprises a subset of the rods described above, consisting of the motorised coupling rods 20, 35 of the first and second cavity 15, 30 and of the motorised controlling rods 11, 26, 26*a*, 26*b*, 43, 46, 46*a*, 46*b* of the three coupling waveguide irises 12, 28, 44.

As set above, the motorised coupling rod 20 of the first cavity 15 allows to control the coupling between the first vertically polarized resonant mode and the second horizontally polarized resonant mode, while the motorised coupling rod 35 of the second cavity 30 allows to control the coupling between the third horizontally polarized resonant mode and the fourth vertically polarized resonant mode. Also, the motorised controlling rod 11 of the first iris 12 allows to couple an external vertical field into the first circular cavity 15, the first motorised controlling rod 26 of the second iris 28 allows to couple the second and the third horizontally polarised resonant mode, the second motorised controlling rod 46 of the second iris 28 allows to negatively couple the first and the fourth vertically polarised resonant modes, and the motorised controlling rod 43 allows to couple the fourth vertically polarised resonant mode inside cavity 30 to an external vertical field.

All the slots of the irises, i.e. the input slot 10, the coupling slot 25 and the output slot 42, are properly designed using modal techniques so as to have appropriate coupling values and thicknesses which allow the controlling rods 11, 26, 43 and 46 to be inserted in the respective slots.

The cavities and the irises of the dual mode cavity filter 5 are made of metal or are coated with metal, for example they are made of silver plated invar. The controlling, coupling and tuning rods are preferably made of dielectric material, for example ceramic, such as E7000 produced by Temex Ceramics; in other embodiments, the rods are made of metal or are coated with metal, for example they are made of silver plated invar.

According to a preferred embodiment of the present invention, the dual mode cavity filter 5 is equipped, in predetermined positions 56, with devices adapted to determine and control how much the controlling, tuning and coupling motorised rods, described above, are inserted inside their respective filter cavity or iris slot, i.e. to control insertion lengths of rods, as shown in FIG. 1*b* (where, for the sake of simplicity, only the devices adapted to control the insertion length of the tuning and coupling rods inside the dual mode cavities are shown).

The insertion length of each motorised rod is controlled by the respective device so that each rod can be moved from a position completely outside the respective filter cavity or iris slot to a position wherein the rod is at least partially introduced into the respective filter cavity or iris slot.

Figure 2:
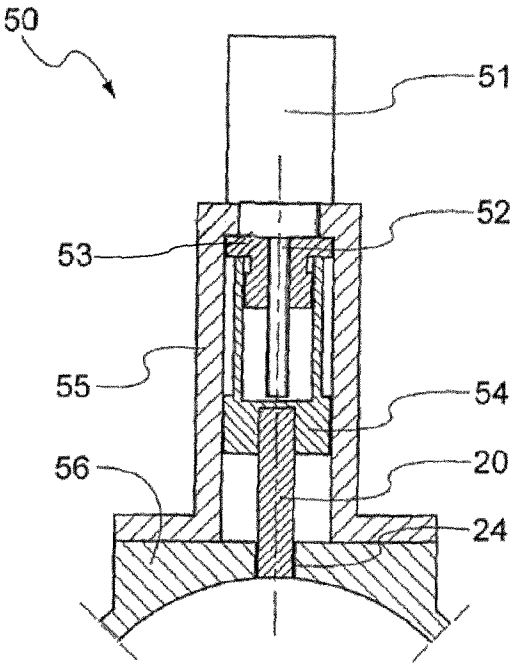
FIG. 2 shows a section view of a device for controlling the insertion length of a rod.

With reference to FIG. 2, a device 50 adapted to control the insertion length of a coupling or tuning rod is an electro-mechanical device. The electro-mechanical device 50 comprises a motor 51, preferably an electrically controlled micro-motor, which is connected to suitable driving electronics 70 by means of electric wires 19. The micro-motor is adapted to make a leadscrew 52 to accurately rotate clockwise or counter-clockwise, according to input electrical signals supplied by the driving electronics 70.

The leadscrew 52 is preferably coupled to a non-rotating nut 53, which is adapted to slide forward or backward according to the clockwise or counter-clockwise rotation of the leadscrew 52.

The non-rotating nut 53 is preferably connected, in turn, with a bush 54. This is made, for example, by securely screwing a first end of the bush 54 onto the nut 53. Therefore, the bush 54 slides forward and backward together with the nut 53.

A second end of the bush 54 is provided with a recessed cavity adapted for securely lodging a rod, for instance the coupling rod 20.

The device 50 preferably includes an external housing 55 having a shape adapted to be applied onto the cavity.

The housing may have a base comprising a curvature substantially identical to that of the cavity.

According to the preferred embodiment, in each predetermined position 56 of the cavity filter 5 a passage 24 is comprised through which the rod 20 can move forward and backward.

The particular configuration of the nut 53 and bush 54 allows a central sliding of the coupling rod 20 through the passage 24.

According to the embodiment of the dual mode cavity filters comprising ceramic rods, the passage 24 is adequately enlarged so as to avoid any contact between the passage 24 and the ceramic rod 20, as shown in FIG. 2, in order to avoid frictions between the rod 20 and the passage 24 due to the rod movements.

Figure 3:
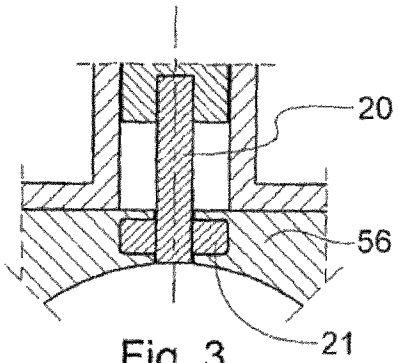
FIG. 3 shows a section view of a detail of a device for controlling the insertion length of a rod.

According to the embodiment comprising metallic or metal plated rods, a ceramic ring 21 is preferably used for avoiding the contact between the metallic rod 20 and the passage 24, as shown in FIG. 3.

Devices similar to the device 50 described above are also used to control the insertion length, for instance, of the controlling rods 11, 26, 26*a*, 26*b*, 43, 46, 46*a* or 46*b* inside the slots of the irises.

Despite the above description refers to a dual mode cavity filter with two circular waveguide cavities, the above disclosed devices and commanded rods can also be applied, mutatis mutandis, to dual mode cavity filters having a single waveguide cavity or more than two waveguide cavities.

Moreover, according to further embodiments of present invention, the cavities can be of any shape having a cross section with at least two orthogonal axes of symmetry, for instance a circular, an elliptical, a square cross section, etc.

Figure 4:
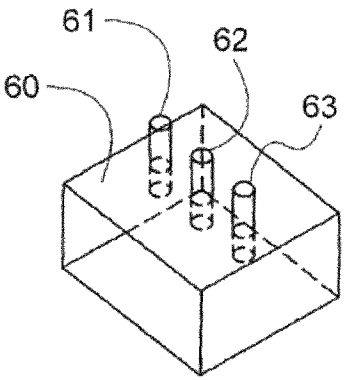
FIG. 4 shows a perspective view of a waveguide section with a plurality of rods.

Furthermore, the disclosed devices and commanded rods are also applied to a waveguide manifold, so as to change the boundary conditions of the waveguide manifold by modifying the insertion length of the rods inside the waveguide manifold. By doing so, as known by a skilled in the art, the electrical length of the waveguide manifold can be adjusted. For example, as shown in FIG. 4, a section of a waveguide manifold 60 is associated with three motorised rods 61, 62, 63, whose insertion lengths inside the waveguide section 60 are controlled by the same device disclosed above for controlling the rods of the dual mode cavity filter (in FIG. 4, for the sake of simplicity, the device is not shown).

The operation of the dual mode cavity filter described above closely follows that of similar filters with fixed tuning and coupling rods.

By properly placing the rods inside the cavities and the slots, as known by a skilled in the art, boundary conditions of the filter are set, which allow to obtain a determined band-pass transfer function, having a certain bandwidth and centre frequency, as shown in FIG. 6.

The boundary conditions inside the cavities and the slots of the irises of the dual mode cavity filter of the present invention can be changed by changing the insertion length of the controlling, tuning and coupling rods, motorised by means of their respective electro-mechanical devices, thus modifying the bandwidth (operation also known as coupling modification) and centre frequency (operation also known as tuning modification) of the band-pass transfer function of the filter.

In particular, according to an embodiment of the dual mode cavity filter of the present invention, by moving the controlling rods 11, 26, 26*a*, 26*b*, 43, 46, 46*a*, 46*b* and/or the coupling rods 20, 35, the bandwidth of the band-pass transfer function of the filter is modified.

According to another embodiments, by moving the tuning rods 18, 22, 32, 38, the centre frequency of the band-pass transfer function of the filter is modified.

According to a further embodiment, the controlling, coupling and tuning rods are all moved, obtaining the effect of modifying both the bandwidth and the centre frequency of the band-pass transfer function of the filter.

The dual mode cavity filter 5 and the electro-mechanical devices adapted to determine and control the insertion length of the rods of the filter can be part of a filtering assembly, such as an output multiplexer (OMUX) or an input multiplexer (IMUX).

According to another aspect of the present invention, the dual mode cavity filter 5 is part of a system comprising the tele-commanded equipment 80 which controls the plurality of devices 50 associated to the filter.

Figure 5:
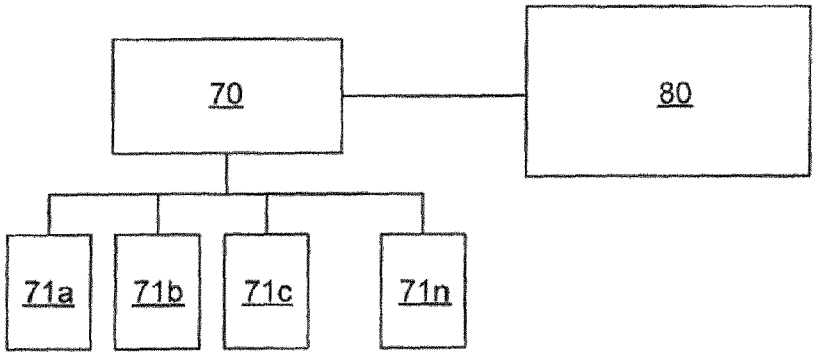
FIG. 5 shows a schematic diagram of a filtering assembly connected to a tele-commanded equipment.

A schematic diagram of such a system is shown in FIG. 5. The system comprises, for instance, a plurality of dual mode cavity filters 71*a*, 71*b*, 71*c*, . . . , 71*n*, for example from 24 to 48 filters, each connected to the driving electronics 70, in order to control the insertion length of the controlling, tuning and coupling motorised rods of each dual mode cavity filter of the system.

The driving electronics 70 is in turn connected to the tele-commanded equipment 80, for example a satellite Telemetry Telecommand and Control (TT&C) system, commonly used to observe and control functions and conditions of the satellite remotely (e.g. from the Earth).

According to the present invention, the tele-commanded equipment 80 is able to receive remotely an instruction to change the bandwidth and/or the centre frequency of the transfer function of one or more dual mode cavity filters of the filtering assembly. The instruction is then processed and transferred to the driving electronics 70, which supplies proper input electric signals to the electro-mechanical devices 50 so as to change the insertion lengths of the rods of the dual mode cavity filters, thus obtaining the desired bandwidth and centre frequency.

According to an embodiment of the system of the present invention, the system comprises a filtering assembly, which comprises a plurality of dual mode cavity filters 5 and devices 50 as described above. The filtering assembly can be, for example, an OMUX having a plurality of dual mode cavity filters 5 coupled to a waveguide manifold. According to the present invention, the waveguide manifold comprises at least one motorised rod and device 50. The use of the motorised rods in the waveguide manifold of the OMUX comprised in the system allows to remotely change the electrical length of the manifold, by means of the tele-commanded equipment, so as to properly couple the dual mode cavity filters 5 whose bandwidth and centre frequency have been remotely modified, thus avoiding performance degradation of the OMUX.

According to another embodiment of the system of the present invention, the filtering assembly comprised in the system is an IMUX comprising a plurality of dual mode cavity filters 5.

Summarizing, the use of motorised rods driven by electro-mechanical devices, according to the present invention, allows to easily change the boundary conditions of filter cavities and iris slots of the dual mode cavity filter, and thus to easily modify the centre frequency and/or bandwidth of the band-pass transfer function of the dual mode cavity filter.

Furthermore, the electro-mechanical devices of the filter are driven, advantageously, by a tele-commanded equipment, able to receive commands and instructions remotely.

Another advantage of the present invention derives from the use of the dual mode cavity filters with motorised rods as part of filtering assemblies installed aboard a satellite. Indeed this solution allows to change, upon request, the centre frequency and bandwidth remotely, e.g. from Earth.

Of course, obvious changes and/or variations to the above disclosure are possible, as regards dimensions, shapes, materials, components, circuit elements, connections and contacts, as well as details of circuitry, of the described construction and operation method without departing from the scope of the invention as defined by the claims that follow.

The invention claimed is:

1. A dual mode cavity filter installed aboard a satellite, comprising:

a first waveguide cavity comprising a cross section with at least two orthogonal axes of symmetry;

a second waveguide cavity comprising a cross section with at least two orthogonal axes of symmetry;

a first coupling waveguide iris comprising an input slot being followed by the first waveguide cavity;

a second coupling waveguide iris comprising a coupling slot, said second coupling waveguide iris following the first waveguide cavity and being followed by the second waveguide cavity; and a third coupling waveguide iris comprising an output slot following the second waveguide cavity, wherein said dual mode cavity filter further comprises a plurality of commanded rods placed in predetermined positions of said cavities and/or of said irises and arranged to perform, in use in outer space, a tuning modification and/or a coupling modification of said dual mode cavity filter as a function of respective insertion lengths of said rods in said predetermined positions of said cavities and/or of said irises, said rods being remotely controllable by way of a plurality of respective devices connectable to a driving electronics and comprising a first coupling rod, displaced by an odd number of 45° angles relative to a first predetermined position in the first waveguide cavity;

a second coupling rod, displaced by an odd number of 45° angles relative to a second predetermined position in the second waveguide cavity;

a first controlling rod, placed in a predetermined position of the first coupling waveguide iris;

a second controlling rod, placed in a first predetermined position of the second coupling waveguide iris;

a third controlling rod, displaced by an odd number of 90° angles relative to the first predetermined position in the second coupling waveguide iris; and a fourth controlling rod placed in a predetermined position of the third coupling waveguide iris.

2. The dual mode cavity filter according to claim 1, wherein each device comprises:

a motor configured to move the respective commanded rod backward and forward at said predetermined positions of said first and second waveguide cavities or of said slots of said irises.

3. The dual mode cavity filter according to claim 2, wherein at least one of said commanded rods is made of ceramic.

4. The dual mode cavity filter according to claim 2, wherein said plurality of commanded rods further comprise:

a first tuning rod placed at a second predetermined position in said first waveguide cavity;

a second tuning rod placed at a third predetermined position in said first waveguide cavity, said third predetermined position being displaced by an odd number of 90° angles relative to said second predetermined position;

a third tuning rod placed at a third predetermined position in said second waveguide cavity; and a fourth tuning rod placed at a fourth predetermined position in said second waveguide cavity, said fourth predetermined position being displaced by an odd number of 90° angles relative to said third predetermined position of said second waveguide cavity, wherein the tuning modification is performed by controlling the insertion lengths of said first to fourth tuning rods.

5. The dual mode cavity filter according to claim 4, wherein said first and second waveguide cavities have a cross section selected from the group consisting of:

a circular cross section, a square or rectangular cross section, and an elliptical cross section.

6. The dual mode cavity filter according to claim 2, wherein said rods are made of metal or are metal plated.

7. The dual mode cavity filter according to claim 2, wherein said first and second waveguide cavities have a cross section selected from the group consisting of:

a circular cross section, a square or rectangular cross section, and an elliptical cross section.

8. The dual mode cavity filter according to claim 2, further comprising:

a housing portion provided in correspondence of said predetermined positions, each of said predetermined positions comprising at least one passage; and components that allow a central sliding of one of said plurality of rods through said at least one passage.

9. The dual mode cavity filter according to claim 8, wherein said passage in said predetermined position comprises a ceramic ring.

10. The dual mode cavity filter according to claim 8, wherein said first and second waveguide cavities have a cross section selected from the group consisting of:

a circular cross section, a square or rectangular cross section, and an elliptical cross section.

11. The dual mode cavity filter according to claim 1, wherein said plurality of commanded rods further comprise:

a first tuning rod placed at a second predetermined position in said first waveguide cavity, a second tuning rod placed at a third predetermined position in said first waveguide cavity, said third predetermined position being displaced by an odd number of 90° angles relative to said second predetermined position;

a third tuning rod placed at a third predetermined position in said second waveguide cavity; and a fourth tuning rod placed at a fourth predetermined position in said second waveguide cavity, said fourth predetermined position being displaced by an odd number of 90° angles relative to said third predetermined position of said second waveguide cavity, wherein the tuning modification is performed by controlling the insertion lengths of said first to fourth tuning rods.

12. The dual mode cavity filter according to claim 11, wherein said first and second waveguide cavities have a cross section selected from the group consisting of:

a circular cross section, a square or rectangular cross section, and an elliptical cross section.

13. The dual mode cavity filter according to claim 1, further comprising:

a housing portion provided in correspondence of said predetermined positions, each of said predetermined positions comprising at least one passage; and components that allow a central sliding of one of said plurality of rods through said at least one passage.

14. The dual mode cavity filter according to claim 13, wherein said passage in said predetermined position comprises a ceramic ring.

15. The dual mode cavity filter according to claim 13, wherein said first and second waveguide cavities have a cross section selected from the group consisting of:

a circular cross section, a square or rectangular cross section, and an elliptical cross section.

16. The dual mode cavity filter according claim 1, wherein at least one of said commanded rods is made of ceramic.

17. The dual mode cavity filter according to claim 1, wherein said rods are made of metal or are metal plated.

18. The dual mode cavity filter according to claim 1, wherein said waveguide cavities have a cross section selected from the group consisting of:

a circular cross section, a square or rectangular cross section, and an elliptical cross section.

19. A system installed aboard a satellite, comprising at least one dual mode cavity filter and a tele commanded equipment;

a plurality of devices associated to said at least one dual mode cavity filter, wherein said devices comprise at least one commanded rod, are placed in predetermined positions of said at least one dual mode cavity filter, and are controlled by said tele commanded equipment so as to perform, in use in outer space, a tuning modification and/or a coupling modification of the at least one dual mode cavity filter on the basis of instructions remotely received by the tele commanded equipment, and wherein said at least one dual mode cavity filter is comprised in an output multiplexer (OMUX) further comprising a waveguide manifold having a certain electrical length, said waveguide manifold being associated to at least one of the plurality of devices being placed in predetermined position of the waveguide manifold and comprising a respective commanded rod, said device being controlled by the tele-commanded equipment so as to change, in use in outer space, the electrical length of the waveguide manifold.

20. The system according to claim 19, wherein said at least one dual mode cavity filter is in an input multiplexer (IMUX).

* * * * *